US006107244A

United States Patent [19]

Zeira et al.

[11] Patent Number: 6,107,244

[45] Date of Patent: Aug. 22, 2000

[54] VERIFICATION METHODS EMPLOYING THERMALLY—IMAGEABLE SUBSTRATES

[75] Inventors: Eitan Zeira; Daniel Ellett, both of Nashua, N.H.

[73] Assignee: Nashua Corporation, Nashua, N.H.

[21] Appl. No.: 09/062,439

[22] Filed: Apr. 17, 1998

Related U.S. Application Data

[60] Provisional application No. 60/062,427, Oct. 15, 1997.

[51] Int. Cl.[7] ..... B41M 5/00

[52] U.S. Cl. ..... 503/201; 503/206; 503/207; 503/226

[58] Field of Search ..... 503/200, 207, 503/226, 206, 201

[56] References Cited

U.S. PATENT DOCUMENTS

| | | | |
|---|---|---|---|
| 3,634,119 | 1/1972 | Klenke | 106/291 |
| 3,650,790 | 3/1972 | Klenke et al. | 106/291 |
| 3,766,105 | 10/1973 | Chan | 260/15 |
| 3,840,381 | 10/1974 | Watanabe | 106/291 |
| 3,887,742 | 6/1975 | Reinnagel | 428/211 |
| 3,926,659 | 12/1975 | Bernhard et al. | 106/291 |
| 3,951,679 | 4/1976 | Bernhard et al. | 106/291 |
| 3,958,057 | 5/1976 | Nishimura et al. | 428/216 |
| 4,047,969 | 9/1977 | Armanini et al. | 106/291 |
| 4,065,158 | 12/1977 | Davis | 503/226 |
| 4,084,983 | 4/1978 | Bernhard et al. | 106/289 |
| 4,086,100 | 4/1978 | Esselborn et al. | 106/291 |
| 4,134,776 | 1/1979 | Rieger et al. | 106/291 |
| 4,146,403 | 3/1979 | Armanini et al. | 106/291 |
| 4,184,872 | 1/1980 | Davis | 43/365 |
| 4,192,691 | 3/1980 | Armanini | 106/291 |
| 4,205,997 | 6/1980 | Hesse et al. | 106/308 |
| 4,268,127 | 5/1981 | Oshima et al. | 350/337 |
| 4,309,480 | 1/1982 | Armanini | 428/403 |
| 4,344,987 | 8/1982 | Ostertag et al. | 427/213 |
| 4,373,963 | 2/1983 | Uenishi et al. | 106/304 |
| 4,425,465 | 1/1984 | Padget et al. | 524/450 |
| 4,436,377 | 3/1984 | Miller | 350/345 |
| 4,457,540 | 7/1984 | Höhne | 283/94 |
| 4,457,784 | 7/1984 | Bernhard | 106/291 |
| 4,472,479 | 9/1984 | Hayes et al. | 428/324 |
| 4,476,181 | 10/1984 | Briggs et al. | 428/220 |
| 4,482,389 | 11/1984 | Franz et al. | 106/291 |
| 4,515,633 | 5/1985 | Cruz, Jr. | 106/18.26 |
| 4,591,887 | 5/1986 | Arbree et al. | 346/200 |
| 4,720,438 | 1/1988 | Watanabe et al. | 428/697 |
| 4,744,832 | 5/1988 | Franz et al. | 106/309 |
| 4,755,229 | 7/1988 | Armanini | 106/413 |
| 4,772,331 | 9/1988 | Noguchi et al. | 106/417 |

(List continued on next page.)

FOREIGN PATENT DOCUMENTS

| | | | |
|---|---|---|---|
| 0 523 888 A1 | 1/1993 | European Pat. Off. | B41M 5/40 |
| 0 657 297 A1 | 6/1995 | European Pat. Off. | B41M 3/14 |
| 0 812 701 A1 | 12/1997 | European Pat. Off. | B41M 5/38 |
| 1 585 104 | 2/1981 | United Kingdom | C01B 33/26 |
| 2 181 563 | 4/1987 | United Kingdom | B41M 5/18 |

OTHER PUBLICATIONS

EM Industries, Inc., "Introduction to Afflair", cover page, pp. 1–6, back cover© 1991 (no date).

EM Industries, Inc., "Afflair Pearl Lustre Pigments", cover page, Contents, pp. 1–10, back cover (no date).

James Carroll Jr., "Measuring Pearlescent Color", *Modern Paint and Coatings,* pp. 30–34 (Sep. 1997).

L.M. Greenstein, "Nacreous (Pearlescent) Pigments", *Pigment Handbook,* 1:cover sheet, pp. 871–890 (1973).

*Primary Examiner*—Bruce H. Hess
*Attorney, Agent, or Firm*—Testa, Hurwitz & Thibeault, LLP

[57] ABSTRACT

Thermally-imageable articles which allow verification of the genuineness of the articles, and methods of producing such articles are disclosed. The thermally-imageable articles includes a substrate and a light transmissive/reflective platy pigment in or on one or both surfaces of the article. The article may be analyzed or inspected to determine the presence and nature of the platy pigment and accordingly, the authenticity of the article. When viewed from different incident angles, the pigment produces a unique pearlescent, color shift, or iridescent type effect.

13 Claims, 1 Drawing Sheet

U.S. PATENT DOCUMENTS

| | | | |
|---|---|---|---|
| 4,806,128 | 2/1989 | Figueras | 8/650 |
| 4,828,623 | 5/1989 | Nitta et al. | 106/450 |
| 4,867,793 | 9/1989 | Franz et al. | 106/415 |
| 4,867,794 | 9/1989 | Ambrosius et al. | 106/417 |
| 4,867,795 | 9/1989 | Ostertag etal. | 106/459 |
| 4,871,591 | 10/1989 | Sugimura et al. | 427/388.5 |
| 4,883,539 | 11/1989 | Mattila et al. | 106/417 |
| 4,888,233 | 12/1989 | Brew | 428/220 |
| 4,952,245 | 8/1990 | Iwano et al. | 106/404 |
| 4,956,019 | 9/1990 | Noguchi et al. | 106/415 |
| 4,956,223 | 9/1990 | Arai et al. | 428/212 |
| 4,968,351 | 11/1990 | Ahmed et al. | 106/402 |
| 4,971,697 | 11/1990 | Douden et al. | 210/502.1 |
| 4,973,621 | 11/1990 | Buter | 524/460 |
| 4,976,787 | 12/1990 | Ito et al. | 106/441 |
| 5,008,143 | 4/1991 | Armanini | 428/207 |
| 5,022,923 | 6/1991 | Rau et al. | 106/415 |
| 5,032,429 | 7/1991 | Diefenbach et al. | 427/215 |
| 5,091,011 | 2/1992 | DeLuca, Jr. | 106/417 |
| 5,120,365 | 6/1992 | Kogler | 106/415 |
| 5,130,291 | 7/1992 | Okuda | 503/207 |
| 5,154,765 | 10/1992 | Armanini | 106/401 |
| 5,219,821 | 6/1993 | Arbee et al. | 503/226 |
| 5,223,360 | 6/1993 | Prengel et al. | 430/39 |
| 5,308,824 | 5/1994 | Matsushita et al. | 503/226 |
| 5,340,692 | 8/1994 | Vermeulen et al. | 430/233 |
| 5,500,313 | 3/1996 | King et al. | 430/11 |
| 5,516,153 | 5/1996 | Kaule | 283/85 |
| 5,520,956 | 5/1996 | Kieser et al. | 427/203 |
| 5,524,934 | 6/1996 | Schwan et al. | 283/95 |
| 5,626,966 | 5/1997 | Külper et al. | 428/423.1 |
| 5,637,438 | 6/1997 | Maerz et al. | 430/253 |
| 5,693,691 | 12/1997 | Flaim et al. | 523/436 |
| 5,695,905 | 12/1997 | Savariar-Hauck et al. | 430/162 |
| 5,695,906 | 12/1997 | Nishi et al. | 430/190 |

VERIFICATION METHODS EMPLOYING THERMALLY— IMAGEABLE SUBSTRATES

CROSS REFERENCE TO RELATED APPLICATIONS

This application claims priority to U.S. Provisional Application 60/062,427, filed Oct. 15, 1997, the entire disclosure of which is incorporated herein by reference.

STATEMENT REGARDING FEDERALLY SPONSORED RESEARCH OR DEVELOPMENT

N/A

BACKGROUND OF THE INVENTION

The invention relates to methods of verifying and authenticating printed articles, in particular methods of verifying and authenticating thermally-imageable printed articles such as venue tickets, pharmaceutical prescription container labels, and the like.

Differentiating genuine articles from fakes or frauds has become an important part of modern business. It is estimated that millions of dollars of business are lost yearly due to the passing off of counterfeit items as genuine articles. The problem spans a wide variety of industries, including travel and entertainment, which use printed tickets subject to counterfeiting; and manufacturing and service industries, in which fake or substandard articles (as widely varied as compact discs, computer software, pharmaceutical prescriptions, etc.) are marked for sale with labels imitating the original. The presence of fake goods in the marketplace results in significant losses of money and goodwill to vendors, as well as detriments to consumers. Customers may be harmed when purchasing fake goods which are passed off as those produced by a well-known manufacturer because they believe they are paying for genuine goods when in fact they may be receiving substandard goods. Additionally, if the customer attempts to return or exchange defective goods under warranty, he may find he cannot because the manufacturer will not honor the warranty. Therefore, as fake and falsely-labeled articles continue to enter specific markets, the need for verification methods and systems which enable consumers, retailers, manufacturers, etc. to identify genuine articles has become more pointed.

Thermally-imageable substrates such as thermal paper have many applications. These "direct thermal" papers have been used in great volume in document printers and fax machines. However, as ink jet and electrostatographic printing technologies have diminished the use of direct thermal papers, direct thermal has found a niche as the printing mode of choice for applications where variable information on demand is needed, such as airline tickets and boarding passes, luggage tags, parking tickets, venue tickets such as concert and theater tickets, lottery receipts, point of sale receipts, and pharmaceutical and grocery labels.

A distinct benefit of direct thermal is that no ink or ribbon needs to be replenished in the printers and the coated thermal paper is relatively inexpensive. However, counterfeiting of lottery tickets, gaming tickets and concert tickets present a significant revenue loss to these industries. These articles are simply photocopied and sold as the genuine article. Also, in retail stores, receipts have been known to be photocopied and then resubmitted by the unscrupulous for refunds on merchandise that were never purchased. Furthermore, since thermal printing apparatus and paper is widely available, it is also relatively easy to produce counterfeit thermally-printed articles, and it is difficult to determine a fake thermally-printed article from genuine article.

Various solutions to the problem, i.e., use of holographic labels, watermarks, etc. have been proposed. However, it is difficult to print such labels by conventional means, and the labels cannot be used in thermal printing apparatus.

It is therefore an object of this invention to provide methods of authenticating printed articles such as labels, tickets, or lottery stubs by imparting special optical properties to the printed surfaces thereof, and systems which enable such authentication methods to be practiced.

BRIEF SUMMARY OF THE INVENTION

The present invention employs thermally-imageable web substrates comprising a light transmissive/reflective platy pigment in or on one or both surfaces thereof which, when viewed from different incident angles, renders a pearlescent, semireflective, color shift, or iridescent type effect under light. These thermally-imageable substrates enable the verification methods disclosed herein to be carried out.

In one embodiment, the authenticity of a thermally-imageable substrate having a thermally-imageable layer with printed indicia thereupon, such as concert or venue information, having a security layer comprising a light transmissive/reflective platy pigment (advantageously disposed on the thermally-imageable layer) is verified by visually inspecting the article to determine the presence or absence of the security layer in order to determine the authenticity of the article. Visual inspection of a second reference article, having the authentic indicia and security coating, compared against the first article to determine the presence and particular character of the security layer, e.g., a blue "color shift" effect, i.e., a characteristic color or appearance which changes with variations in the viewing angle, can also enable determination of the authenticity of the first article.

One or more layers of the thermally-imageable substrate may be provided which contain a light transmissive/reflective platy pigment such as metal flakes, nacreous pigments like metal oxide-coated mica, or holographic flakes. The light transmissive/reflective platy pigment may be dispersed in a layer disposed over at least one surface of the substrate, and in some cases the light transmissive/reflective platy pigment may be incorporated in the substrate or the thermally-imageable layer itself.

Additionally, a thermally-imageable substrate may comprise a pearlescent security layer disposed over the thermally-imageable layer, wherein the pearlescent layer contains the aforementioned platy pigment. Another embodiment includes a barrier layer disposed between the pearlescent layer and the thermal layer, which advantageously provides better spreading and adhesion of the pearlescent layer.

BRIEF DESCRIPTION OF THE DRAWINGS

Other features and advantages of the invention will be apparent from the following Detailed Description of the Invention thereof, taken in conjunction with the accompanying drawings, in which.

DETAILED DESCRIPTION OF THE INVENTION

Figure 1A:
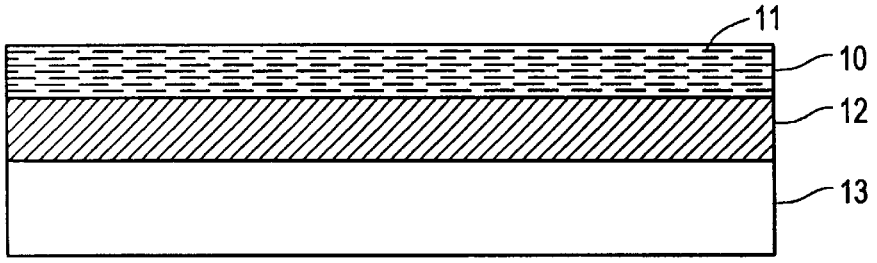
FIGS. 1*a*–1*e* depict various embodiments of thermally-imageable substrates in accordance with the disclosure.

In accordance with the presently disclosed verification methods, a thermally-imageable substrate serves as the medium on which the desired indicia are printed using thermal printing methods. Examples of such indicia include travel information, e.g., for thermally-imageable airline tickets; pharmaceutical information, for, e.g., thermally-imageable prescription container labels, and lottery or gaming information on thermally-imageable lottery tickets. The verification method involves an analysis of a thermally imageable substrate bearing the particular printed indicia to determine whether the substrate has the particular pearlescent and/or colored pearlescent surface characteristics of the authentic article. These characteristics may be readily determined by optical instrumentation such as a goniospectrophotometer, or by visual inspection if a more qualitative determination will suffice.

The thermally-imageable substrates disclosed herein have a thermally-imageable layer which is generally known in the art, e.g., as described in U.S. Pat. No. 4,591,887. The thermally-imageable layer generally includes a binder, typically a polymeric binder; a colorless or pale leuco dye, preferably in particulate form; an acidic developer substance to cause the dye to undergo color transformation upon imagewise application of heat to the thermally-imageable substrate; and preferably an acid-neutralizing (basic) material for reducing background coloration.

The dye may be of the type generally known in the art which is activated by contact with a proton donating (acidic) substance such as a metalized, e.g., zincated, organic acidic material. Suitable dyes are fluoran, lactone, phthalide, or triaryl methane dyes such as crystal violet lactone, 3-N-cyclohexyl, N-methyl-amino 6-methyl-7-anilino fluoran, or 3-pyrrolidino-6-methyl-7-anilino fluoran. Other leuco dyes known in the art may be used. The dye is typically present in particulate form, preferably as micron-size range for adequate resolution as known by those skilled in the art.

The acidic developer substance may comprise an organic acidic material, optionally treated with a metal such as zinc. Examples include bisphenol A, phenolic condensation products, and various low melting point organic acids or their esters.

The binder is typically a polymeric binders or mixtures thereof, which is, for processing purposes, at least partly water-soluble. Examples include polyvinyl alcohol, polyvinyl pyrrolidone, polyacrylamide, styrenemaleic anhydrides, or modified cellulose.

The neutralizing agent may comprise a neutral colored, water-insoluble particulate material. Other additives, such as inert fillers, lubricants, dispersants, may be present also.

The substrate on which the various coating layers are disposed may be any self-supporting material or film onto which the layer(s) may be stably coated, and which is suitable for thermal printing and the desired end use, but paper or card stock, in the desired thickness or strength for the particular application is generally preferred.

The thermally-imageable substrates include a layer containing light transmissive/reflective platy pigments. "Light transmissive/reflective," as used herein, refers to the ability exhibited by, e.g., nacreous pigments to be both transmissive and reflective to incident light, which provides articles containing such pigments with their unique surface optical characteristics (see, e.g., Carroll Jr., *Measuring Pearlescent Color*, Modern Paint and Coatings, September 1997 pp. 30–34, incorporated herein by reference.)

Examples of light transmissive/reflective platy pigments in accordance with the disclosure include metal flakes, nacreous pigments such as metal oxide-coated mica platelets, or holographic flakes. Such nacreous pigments are commercially available, e.g., under the trade name AFFLAIR® (EM Industries) such as AFFLAIR pigments no. 219, 231, 309, and 329; and MEARLIN® DYNACOLOR (Englehard Corporation, Iselin, N.J.) pigments such as DYNACOLOR RB and GB. Suitable holographic flakes include GEOMETRIC PIGMENTS™ available from Spectratek Corporation. The mean particle size of these pigments is generally in the range of 1 to 200 $\mu$m. As detailed hereinbelow, these platy pigments are generally included in a layer on the substrate and as such should be capable of being well-dispersed in a liquid coating medium which is coated onto a web surface to provide the layer. However, it is also contemplated that, as discussed below, the platy pigments may be incorporated into the web material itself.

The amount of pigment which may be incorporated in the security layer may be empirically determined, so as to provide the desired pearlescent or iridescent effect. However, amounts of pigment generally from about 5%–90%, preferably from about 5%–60%, more preferably 20%–50%, based on the total weight of resin and pigment, has been determined to be adequate.

In embodiments where the light transmissive/reflective platy pigments are incorporated in a security layer, known binder compositions such as polyvinyl alcohols; butyl acrylates; polymethylmethacrylates; epoxies; and UV/electron beam-curable coatings (which can preferably provide a high cross-linking density); and those disclosed in U.S. Pat. No. 5,219,821, incorporated herein by reference, are used to provide a cohesive medium for the platy pigments, when dry, and can also serve a protective function. These layers may be coated onto the substrate surface(s) using conventional coating methods such as a bar coaters, rod coaters, gravure coaters, air knife coaters, docter blade coaters, etc. Crosslinking of the coating is advantageous since this imparts increased water resistance and ameliorates printhead residue.

One especially useful thermally-imageable substrate includes a pearlescent security layer containing nacreous pigments in a resin binder (preferably cross-linked), which is disposed over the thermally-imageable layer of the substrate. The presence of the nacreous pigments in the security layer provides the surface of the thermally-imageable substrate with a lustrous or iridescent effect, which cannot be reproduced by duplication by, e.g., photocopying or scanning and printing.

The particular light transmissive/reflective platy pigment can also be chosen to impart a characteristic color to the thermally-imageable substrate, giving the substrate certain desirable aesthetic qualities. For example, depending on the particular pigment that is used, various colors of the spectrum may be imparted to the substrate surface. Light transmissive/reflective platy pigments such as "effect pigments" can also be used advantageously to impart a so-called "color shift" effect to the substrate, i.e., a characteristic color or appearance which changes with variations in the viewing angle. This effect is quite dramatic and easily detected, and is distinct enough to allow for even a casual determination of authenticity. It has also been found that, where the security layer is disposed over the thermally-imageable layer, the abrasion level of the surface of the thermally-imageable substrate when it passes across the thermal print head during the printing operation is greatly reduced. This latter advantage is a benefit for ensuring the longevity of the thermal print head in the thermal printing equipment.

The security layer may contain other additives, especially when disposed over the thermally-imageable layer, such as UV-absorbing or blocking compounds which protect the thermal layer against unwanted background exposure, and lubricants, such as disclosed in U.S. Pat. Nos. 4,898,849 and 5,141,914, which prevent the paper from binding up with or sticking to the thermal printhead during printing operations.

Figure 1B:
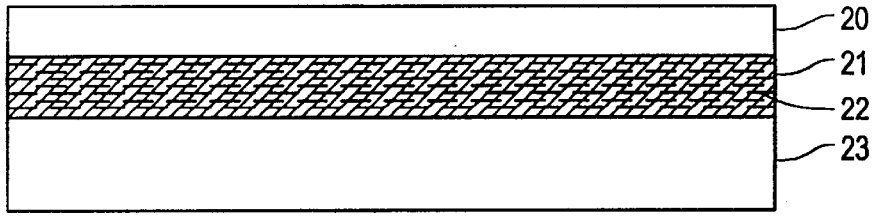

It is also possible, as noted above, to incorporate the platy pigments in other layers of the thermally-imageable substrate, using techniques familiar to those in the art. Referring to the drawings, FIGS 1*a*–1*e* show examples of other such embodiments of thermally-imageable substrates, in simplified cross-section. One advantageous embodiment is shown in FIG. 1*a*, depicting a security layer comprising platy pigment 11, thermally-imageable/color forming layer 12 comprising the heat-sensitive color developing system, and substrate, such as paper, 13. Another embodiment is shown in FIG. 1*b*, depicting a light transmissive barrier layer 20, thermally-imageable/color forming layer 21 comprising platy pigment 22, and substrate, such as paper, 23.

Figure 1C:
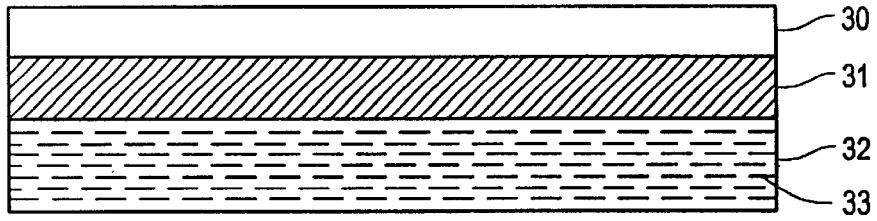

Another embodiment as shown in FIG. 1*c* may comprise a light transmissive barrier layer 30, a thermally-imageable/color forming layer 31, and substrate 32 containing platy pigments 33 dispersed therein. A different pearlescent effect, i.e., visible from either side of the substrate, may be obtained by means of this embodiment.

Figure 1D:
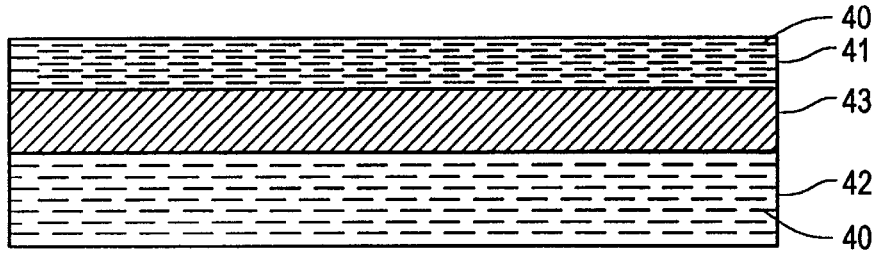

Another alternative, as shown in FIG. 1*d*, incorporates platy pigment 40 in both security/barrier layer 41 and substrate 42, "sandwiching" thermal layer 43, wherein, e.g., differing concentrations of the platy pigment are contained in the barrier layer and substrate, respectively. This would have the advantage of providing different intensities of pearlescent effect for each surface of the substrate. Alternatively, different colored platy pigments may be incorporated in the security/barrier layer and the substrate, respectively, so as to "color" the substrate blue (or provide a blue color shift) while "coloring" the barrier layer gold. Thus, when activation of the thermal layer takes place, the blue color under the imaged area would disappear leaving gold color showing in that area, whereas the unimaged regions would still have the original color effect. This concept may be extended to produce various color effects using this color subtraction technique.

Figure 1E:
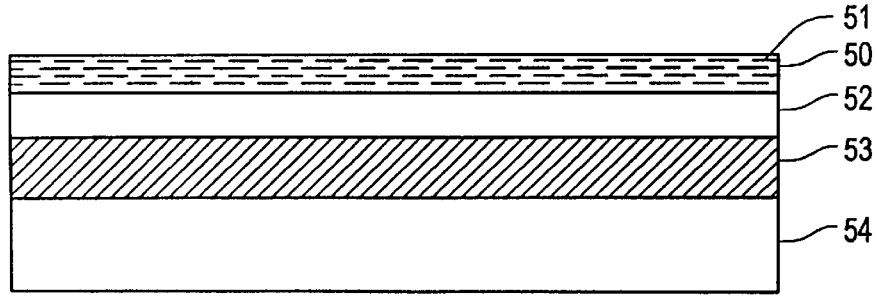

Yet another embodiment, illustrated in FIG. 1*e*, comprises a four-layer thermally-imageable substrate comprising a layer 50 containing platy pigment 51, which is disposed over light transmissive layer 52, which in turn is disposed over color forming layer 53, which is finally disposed over substrate 54. This embodiment is particularly advantageous as layer 52 provides better coating, spreading and adhesion of layer 50 to layer 53 during the coating process.

The presently disclosed thermally-imageable substrates and techniques may be used in existing thermal printers. This is advantageous since it allows anti-counterfeiting measures to be employed without hardware modifications.

The coated thermally-imageable substrates may be prepared using standard substrate coating techniques, as shown in the following non-limiting description of how one embodiment of a thermally-imageable substrate in accordance with the disclosure is made.

EXAMPLE

A thermally-imageable paper in accordance with the disclosure was prepared by coating a thermally-imageable paper (standard thermal grade paper from Nashua Corporation) with a coating containing a pearlescent pigment as follows. An "A" mix was prepared as follows. To a steam-jacketed tank with continuous stirring was added 1390 parts hot water and 128 parts polyvinyl alcohol (fully hydrolyzed, high viscosity material with a molecular weight average of 106,000–110,000 (AIRVO 350, Air Products and Chemicals, Allentown, Pa.). 24 parts of fumaric acid was added and the temperature raised to 190° F. and held for 30 minutes. A dispersing agent (DARVAN 7, 25% solution) was added in 3.6 parts and, after 10 minutes, 145 parts of a pearlescent pigment, e.g., MEARLIN DYNACOLOR RB, was added. After another 30 minutes, 773 parts of cold water was added followed by an additional 15 minutes of mixing.

A "B" mix was prepared by mixing together 125 parts water, 50 parts of a melamine-formaldehyde resin (80% solids) and 0.5 parts of a wetting agent for about 30 minutes. The A and B mixes were thereafter combined in a ratio of 350 parts A to 10 parts B and mixed for 15 minutes to form a "C" mix for paper coating. The C mix was coated onto the thermally-imageable layer of the thermal paper on a rod coater and dried, resulting in a coating weight of 3–4 grams/square meter.

Thermal printing on the above thermal paper was good and the surface had a characteristic pearlescent quality which was easily detected compared to a photocopy of the printed thermal paper.

It should be noted that the invention is not intended to be limited to the preferred embodiments of the invention disclosed herein. Other embodiments and variations will be apparent to those of ordinary skill in the art without departing from the inventive concepts contained herein.

What is claimed is:

1. A method of authenticating a printed article, comprising the steps of:

a. providing a thermally-imageable article comprising:
substrate having first and second surfaces;
at least one thermally-imageable layer disposed over at least said first surface of said substrate; and
at least one security layer comprising a resin binder and a light transmissive/reflective platy pigment dispersed therein, said security layer disposed over said thermally-imageable layer, and said thermally-imageable article having thermally printed indicia thereupon; and b. analyzing said thermally-imageable article to determine whether said article includes said security layer.

2. The method of claim 1 further comprising the step of inspecting said printed indicia to verify the authenticity thereof.

3. The method of claim 1 wherein said thermally-printed indicia comprises travel destination information.

4. The method of claim 1 wherein said thermally-printed indicia comprises lottery or gaming information.

5. The method of claim 1 wherein said thermally-printed indicia comprises concert or venue information.

6. The method of claim 1 wherein said thermally-printed indicia comprises pharmaceutical prescription information.

7. The method of claim 1 wherein said thermally-printable article is a label.

8. The method of claim wherein said thermally-printable article further comprises a barrier layer between said security layer and said thermally-imageable layer.

9. The method of claim 1 wherein said light transmissive/reflective platy pigment is selected from the group consisting of nacreous or interference pigments, holographic flakes and metal flakes.

10. The method of claim 1 wherein said light transmissive/reflective platy pigment is metal oxide-coated mica.

11. The method of claim 1 wherein said resin binder is selected from the group consisting of polyvinyl alcohols; butyl acrylates; polymethylmethacrylates; epoxies; and UV/electron beam-curable coatings.

12. The method of claim 1 wherein said light transmissive/reflective platy pigment is present in said security layer in a range of from about 5% to 90% by weight, based on the total weight of said resin binder and said pigment.

13. The method of claim 1 wherein said light transmissive/reflective platy pigment is present in said security layer in a range of from about 20% to 50% by weight, based on the total weight of said resin binder and said pigment.

* * * * *